US007925034B2

(12) United States Patent
Roeck et al.

(10) Patent No.: US 7,925,034 B2
(45) Date of Patent: Apr. 12, 2011

(54) METHOD FOR OPERATING A HEARING DEVICE AS WELL AS A HEARING DEVICE

(75) Inventors: Hans-Ueli Roeck, Hombrechtikon (CH); Volker Kuehnel, Mannedorf (CH)

(73) Assignee: Phonak AG, Stafa (CH)

( * ) Notice: Subject to any disclaimer, the term of this patent is extended or adjusted under 35 U.S.C. 154(b) by 0 days.

(21) Appl. No.: 12/582,182

(22) Filed: Oct. 20, 2009

(65) Prior Publication Data

US 2010/0034405 A1 Feb. 11, 2010

Related U.S. Application Data

(63) Continuation of application No. 10/044,701, filed on Nov. 9, 2001, now abandoned.

(51) Int. Cl.
*H04R 25/00* (2006.01)
*H04R 3/00* (2006.01)

(52) U.S. Cl. ..... 381/313; 381/92

(58) Field of Classification Search ..... 381/92, 381/321, 313, 107, 109, 102, 103
See application file for complete search history.

(56) References Cited

U.S. PATENT DOCUMENTS

| | | | |
|---|---|---|---|
| 3,875,349 | A | 4/1975 | Ruegg |
| 4,633,495 | A | 12/1986 | Schotz |
| 4,821,329 | A | 4/1989 | Straub |
| 4,881,123 | A | 11/1989 | Chapple |
| 5,361,378 | A | 11/1994 | Traini, Jr. |
| 5,477,270 | A | 12/1995 | Park |
| 5,577,511 | A | 11/1996 | Killion |
| 6,084,167 | A | 7/2000 | Akimoto et al. |
| 6,101,258 | A | 8/2000 | Killion et al. |
| 6,148,086 | A | 11/2000 | Ciullo et al. |
| 6,704,422 | B1 | 3/2004 | Jensen |

FOREIGN PATENT DOCUMENTS

| | | | |
|---|---|---|---|
| EP | 0064042 | A1 | 11/1982 |
| EP | 0341997 | A2 | 11/1989 |
| EP | 0674464 | A1 | 9/1995 |
| WO | 0122790 | A2 | 4/2001 |

*Primary Examiner* — Ping Lee
(74) *Attorney, Agent, or Firm* — Pearne & Gordon LLP

(57) ABSTRACT

In order to switch between different hearing programs to adjust to a momentary acoustic surround situation, a method is provided to operate a hearing device as well as a hearing device. Signals, or parameters of a transfer function, are changed smoothly in order to form a smooth transition from a momentary to a desired value. Thereby, the advantage is obtained to eliminate undesired abrupt switching operation when a hearing program switching is necessary.

10 Claims, 2 Drawing Sheets

METHOD FOR OPERATING A HEARING DEVICE AS WELL AS A HEARING DEVICE

FIELD OF THE INVENTION

The present invention is related to a method to operate a hearing device in which the possibility is given to select a specified hearing program according to a momentary acoustic surround situation as well as to a hearing device.

DESCRIPTION OF THE RELATED ART

Modern hearing devices can be adjusted to different acoustic surround situations by selecting a hearing program which is best suited for a momentary acoustic surround situation. Thereby, the operation of the hearing device is adjusted optimally to the needs of the user of the hearing device.

The selection of a hearing program can either be done by a remote control or over a switch at the hearing device. The switching from one hearing program to another is performed in an abrupt manner in that the parameters of the momentary used hearing program are changed within a short time. As a result thereof, a sudden hearing quality change occurs which is perceived by the hearing device user and which is sensed as unnatural. This is in particular the case if switching of hearing programs takes place automatically—as e.g. described in international patent application WO 01/22790—, i.e. the switching occurs at an unexpected time. It has been established that for an automatic switching from one hearing program, which weights the received acoustic signals according to their direction of occurrence (so-called "beam former"), to an other hearing program, which does not perform any direction-dependent weighting, a sudden and unexpected quality change occurs, which can be heard clearly and which can confuse the hearing device user.

From the European Patent having the publication number EP-B1-0 064 042 such a hearing device is known which incorporates the aforementioned drawbacks resulting from an abrupt switching from one hearing program to another.

Furthermore, reference is made to the European patent application having the publication number EP-A1-0 674 464 in which a hearing device is described having a controller which alters one or several parameters of the transfer function in function of input values of the momentary surround situation by applying the principle of fuzzy logic. The alteration of the parameters is thereby formed by suddenly and in direct dependency of the momentary acoustic surround situation or according to simplified assumptions, respectively. The known hearing device based on this principle is characterized by a complicated assembly which is in particular a result of an adjustment made to the complete transfer function according to the momentary conditions reflecting the acoustic surround situation. In addition, the known hearing device is limited to having one single microphone.

BRIEF SUMMARY OF THE INVENTION

It is therefore an object of the present invention to provide a simple and improved method for switching from one hearing program to an other.

The foregoing and other objects of the invention are achieved by a method for operating a hearing device, whereby the parameters to be changed as a result of a hearing program switching are adjusted from the momentary values to the desired values smoothly in order to form a smooth transition. Therefore, a method to operate the hearing device is provided which allows the switching from one hearing program to an other in a smooth way, i.e. the usually encountered abrupt transition is eliminated. In other words, the unpleasant hearing program switching known so far have been eliminated by the present invention.

In the context of the present invention the term "parameter" not only means single coefficient values of the transfer function of a hearing device, but also signals as described e.g. in connection with the embodiments according to FIG. 1.

BRIEF DESCRIPTION OF THE DRAWINGS

Preferred embodiments of the present invention are hereinafter described by way of example referring to the following drawings, in which.

DETAILED DESCRIPTION OF THE INVENTION

Figure 1:
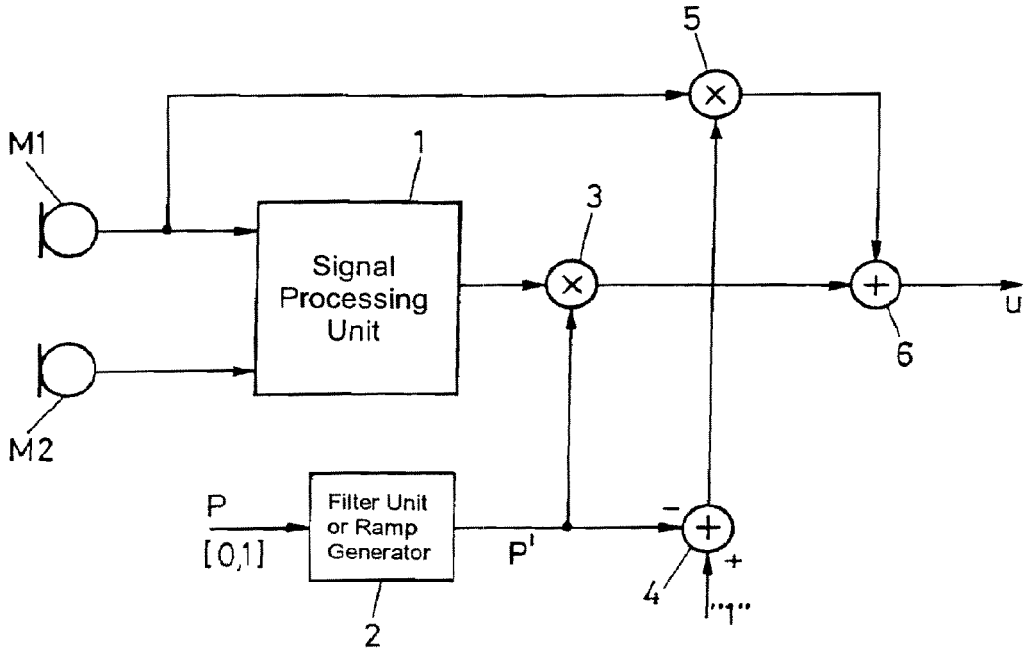
FIG. 1 shows a block diagram of a first arrangement according to the present invention for a hearing device with direction-dependent characteristic.

In FIG. 1, a block diagram is shown of a part of a hearing device having two microphones M1 and M2 for the recording of acoustic signals. Reference is made to a first embodiment of a hearing device in which direction-dependent information is being processed, which means that for such a known hearing device the possibility is given to treat acoustic signals coming for a certain direction in a preferred manner compared to acoustic signals coming form a different place. On the other hand, there is a need that, under certain circumstances, direction-dependent processing of recorded acoustic signals is not wanted. In this case, it is provided that the direction-dependent processing of the signals is being switched off. This can be reached in particular by switching off one of the two microphones M1 and M2, respectively, which results in the processing of only one acoustic signal in the hearing device.

In FIG. 1 the input stage of such a hearing device is shown. The two outputs of the microphones M1 and M2 are being fed to a signal processing unit 1 in which the signals—whether they are available in digital or in analogue form—are being processed in a so-called "beam forming"-algorithm. Further information regarding the beam forming-algorithm is disclosed, for example, in U.S. Pat. No. 6,766,029.

The output signal of the signal processing unit 1 now only contains the acoustic signal parts which are coming from the desired direction, which signal parts are being processed in further processing units (not shown in FIG. 1) of the hearing device, before these signal parts are being fed to the hearer of the hearing device (not shown in FIG. 1 as well).

According to FIG. 1, a first and a second multiplicator unit 3 and 5, respectively, as well as a first and a second summator unit 4 and 6 are being provided to switch on and switch off, respectively, the consideration of direction-dependent information. By P, a switching state is described which can bear the values "0" or "1", whereas the momentary switching state P is fed to a filter unit 2. The output signal of the filter unit 2 is fed to the first summator unit 4—after having reversed its algebraic sign—as well as to a first multiplicator unit 3 to which also the output signal of the signal processing unit 1 is being fed. The constant value "1" is being fed to the first summator unit 4 as second input signal. Furthermore, the output signal of the first summator unit 4 is being fed to the second multiplicator unit 5 having a second input signal to which the first microphone M1 is connected. Finally, the output signals of the first and the second multiplicator unit 3 and 5, respectively, are fed to the second summator unit 6 in order to obtain an output signal u which—as has been already stated above—is being further processed in further processing units of the hearing device, if need be, before being fed to the hearer of the hearing device.

In the following, the functionality of the first embodiment of the present inventions is being described:

If the switching state P has the value "0", the acoustic signal recorded by the microphone M1, assuming steady state, is being switched through to the output u without being further processed. In other words, a hearing program is provided which does not take into consideration any direction-dependent information, i.e. all signals being recorded by the microphone M1 are treated equally, independent of their angle of incidence. Such a signal is also identified by the term "omni signal".

If the switching state P has the value "1", the reversed case occurs, assuming again steady state: Instead of the switching-through of the output signal of the microphone M1 alone to the output signal u, the output signal already generated in the signal processor unit 1 is now switched through to the output u. Thereby, a signal is provided in this switching state P as output signal u which incorporates specific, namely direction-dependent, signal parts. The output signal u is also identified by the term "directional signal".

As has been already described, the switching from one hearing program to another, i.e. from the "omni signal" to the "directional signal" and vice versa, can result in confusion of the hearing device user, especially in case the switching is done automatically, i.e. without any ado by the hearing device user, in other words, if the switching is a surprise for the hearing device user. According to the present invention, it is therefore provided that a smooth transition is arranged for a state change of a switching state P in order to obtain a smooth transition from an "omni signal" to a "directional signal" and vice versa, respectively. Therefore, it is provided for a preferred embodiment of the present invention to realize a low-pass filter of first order in the filter unit 2, which low-pass filter preferably has a time constant of approx. 1 second. It is also conceivable to use a ramp generator or a similar algorithm instead of a low-pass filter in the filter unit 2 in order to realize a smooth transition.

The filter unit 2 causes a weighting of the outputs of the signal processing unit 1 and of the first microphone M1 in that the output of the signal processing unit 1 is directly multiplied by the output signal of the filter unit 2, in that, furthermore, the output of the first microphone M1 is multiplied by the inverted output of the filter unit 1, which output is being increased by the value of "1", and in that, finally, the two weighted signals are added together in the second summator unit 6. The values of the switching state P are equal to "0" or equal to "1" as can be seen from FIG. 1. Accordingly, also the output signal of the filter unit 2 is within this range, but all values between the two extreme values can be adapted.

In a further embodiment of the present invention, it is feasible that an extended range as the one given above can be used in order to obtain different mixing ratios and/or different amplification factors.

Figure 2:
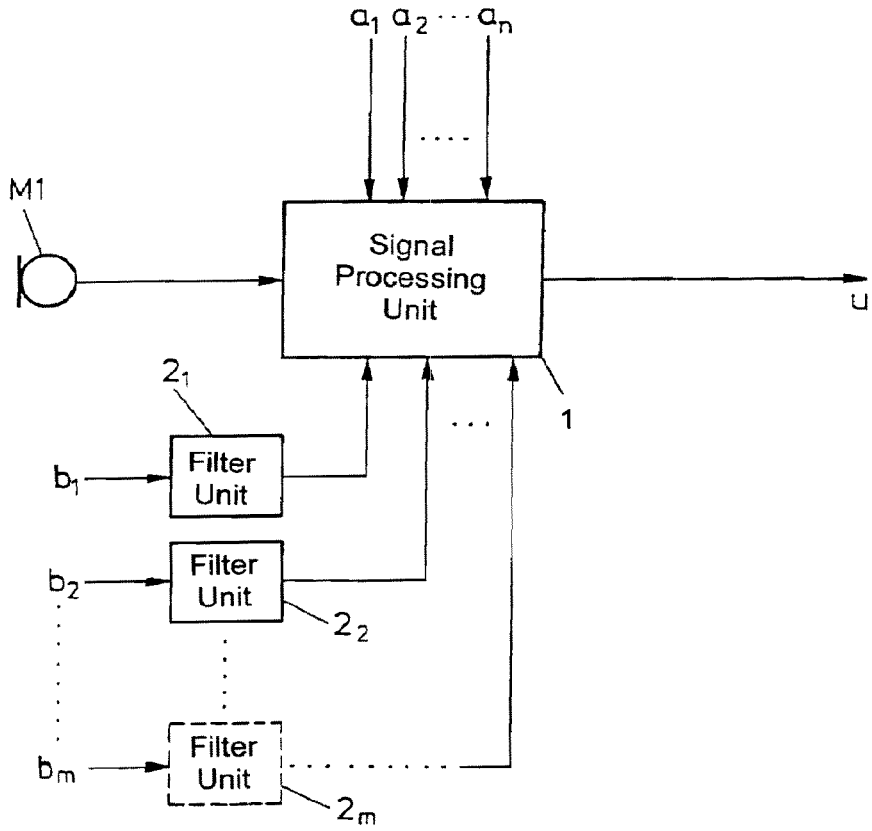
FIG. 2 shows a block diagram of a second arrangement according to the present invention in which the alteration of single parameters of a hearing device transfer function is provided.

In FIG. 2, a block diagram is shown of a further embodiment of a hearing device according to the invention, which block diagram is again shown in part and schematically. In this embodiment of the present invention, an algorithm for noise canceling is being used. Therefore, a transfer function is determined in the signal processing unit 1 in which an input signal from the microphone M1 is being processed. Output signal u of the signal processing unit 1 is treated, as already in the embodiment according to FIG. 1, in further processing units in the hearing device, if need be, and is being finally fed to the hearer of the hearing device.

The transfer function generated in the signal processor unit 1 has a number of parameters $a_1$ to $a_n$ and $b_1$ to $b_n$, respectively, whereas the parameters $a_1$ to $a_n$ remain unchanged if another hearing program is selected. The parameters $b_1$ to $b_n$ are being changed by a different hearing program selection. According to the present invention, filter units $\mathbf{2}_1$, to $\mathbf{2}_n$ are provided as a consequence to the description of the embodiment according to FIG. 1, which filter units $\mathbf{2}_1$ to $\mathbf{2}_n$ have input values corresponding to the parameters $b_1$ to $b_n$ in order to obtain a smooth transition from the momentary value of a parameter to a predefined target value. The parameter values being smoothed in the filter units $\mathbf{2}_1$ to $\mathbf{2}_m$ as well as the unchangeable values of the parameters $a_1$ to $a_n$ are being fed to the signal processing unit 1 in which the transfer function is being determined.

Figure 3:
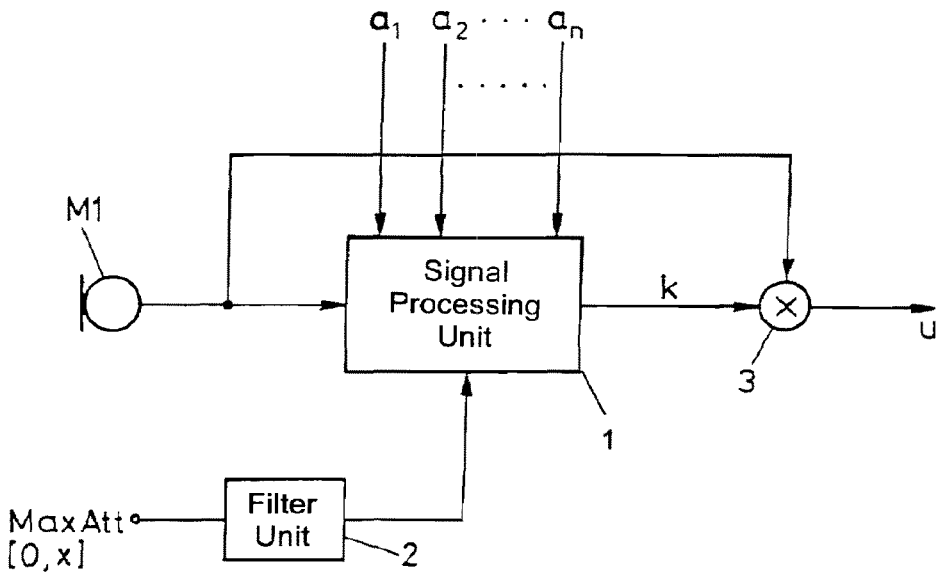
FIG. 3 shows a block diagram of a specific embodiment of the arrangement according to FIG. 2.

For further explanation of the more general embodiments of the invention according to FIG. 2, a specific embodiment of the invention is shown in FIG. 3. Besides the parameters $a_1$ to $a_n$ which experience no change by switching from one hearing program to another, a parameter MaxAtt is adjustable. Thereby, the parameter MaxAtt obtains either the value of "0" or the value x. For the use of an algorithm to suppress noise, the parameter MaxAtt corresponds to the maximum attenuation of a noise suppression of the type "spectral subtraction" which is applied to increase the signal noise ratio (SNR).

In contrast to the embodiment according to FIG. 2, the output signal u is not directly determined by the signal processing unit 1 in the embodiment according to FIG. 3, but an attenuation factor k is determined using the signal processing unit 1, which attenuation factor k is applied to the output signal of the microphone M1 over a multiplicator unit 3. The output signal of the multiplicator unit 3 corresponds then to the signal u which is further processed, as the case may be, according to the above mentioned explanation.

The filter unit 2 again can be realized in an embodiment explained in connection with the one according to FIG. 2. Furthermore it is feasible that the two embodiments of the invention according to FIG. 1 and according to FIGS. 2 and 3, respectively, are combined.

Figure 4:
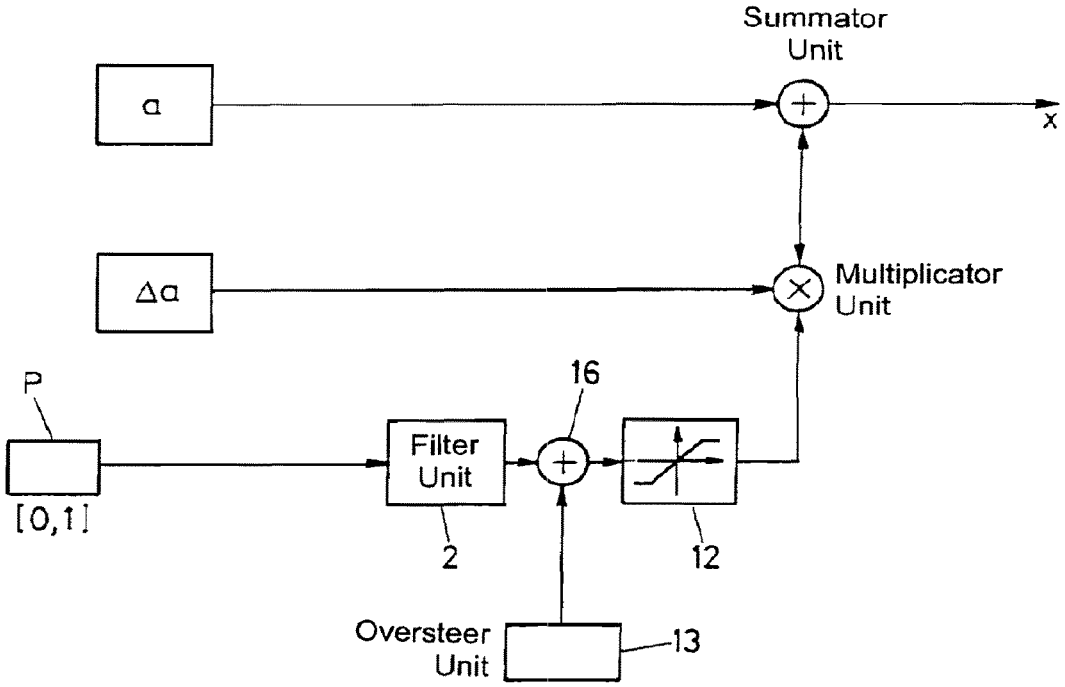
FIG. 4 shows a block diagram of a specific embodiment for the alteration of single parameters.

In FIG. 4, a possible embodiment of the invention, again in a block diagram, is shown, which embodiment is used to change or adjust, respectively, a parameter, whereby the additional possibility is given to force a parameter change without delay in a direct manner, i.e. by bypassing the filter unit 2.

For the embodiment according to FIG. 4, it is provided that a parameter obtains a value a or a value a+Δa, namely in dependency on a selection of a hearing program, whereby a switch is determined by a state change of a switch state P which obtains a value "0" or "1". In the steady state, the signal x has a value a if the switch state P has a value "0", and a value a+Δa if the switch state P has a value "1".

For a state change, a smooth transition from one value to another is formed again using a filter unit 2, whereby a limiter unit 12 provided after the filter unit 2 is used in order that a maximum and minimum value, respectively, is not trespassed.

Furthermore, an oversteer unit is identified by the reference sign 13 with which a parameter change is directly effected by bypassing the filter unit 2. Therewith, a possibility is given to manually select a desired hearing program by the hearing device user, which hearing program is taking effect immediately after its selection, i.e. the generation of a smooth transition is therewith omitted knowingly. Thereby, the hearing device user is in a position to better estimate the possible performance of the new hearing program. In connection with the oversteer unit 13, it is possible that the hearing device user also obtains the possibility to select any value for x in the given range between a and a+Δa. It is provided, over the oversteer unit 13, that any value between "+1" may have effect on the signal path over the summator unit 16 and not only the values "0" and "1" in order to increase or decrease, respectively, the value of the signal x. In order that the value of the signal x does not trespass the given limits a and a+Δa, respectively, the limiter unit 12 is provided which limits the output signal of the summator unit 16 between the value "0" and "1", respectively.

In dependence on the aforesaid explanations, it is provided that a smooth transition is generated in the sense of the above explanation whenever an automatic hearing program switching occurs. In other words, the switching state P according to FIGS. 1 and 4 is being undertaken automatically with the aid of an algorithm to recognize the momentary acoustic surround situation. In connection with the recognition of the momentary acoustic surround situation, reference is made to the two U.S. patent applications with the publication numbers US-2002-0037087 and US-2002-0090098, which contents are herewith incorporated by reference.

In a further embodiment of the present invention, it is provided that the values for the switching state P can take any values in the range between "0" and "1".

It is pointed out that basically all parameters, which are changed within the scope of a hearing program switching, obtain a smooth transition according to the present invention. As examples, the following parameters are mentioned which are processed either alone or in combination according to the aforesaid explanations:

- maximum attenuation;
- width of registration, i.e. direction sharpness of a beam former;
- amplification;
- compression;
- scaling;
- operating point of a noise suppression unit according to FIG. 3;
- time constant of the compression;
- compression knee point;
- limiter;
- operating point of the suppression unit for the signal feedback;
- operating point of a recognition unit of the acoustic surrounding.

The invention claimed is:

1. A method for operating a hearing device in which one of several possible hearing programs is automatically selectable by the hearing device at a given time in order to adjust to a momentary acoustic surround situation, which is automatically recognizable by the hearing device, said adjustment being made in that parameters of a transfer function provided between a microphone and a receiver are changed, where the parameters to be changed according to the hearing program switching are adjusted from a momentary value to a new value in a smooth manner in response to a filter unit, the filter unit having a timed response to a bi-level switching state value, said timed response controlling said changes, wherein the hearing device includes, for manually selecting a hearing program, at least one of an oversteer unit at the hearing device and a remote control having effect on the hearing device, wherein the hearing program is changeable by manual intervention over the oversteer unit at the hearing device or by the remote control having effect on the hearing device, whereby the manually selected hearing program takes immediate full effect upon selection.

2. The method according to claim 1, whereas the smooth transition from a momentary value of a parameter to a desired value is extended over a given time range.

3. The method according to claim 1, whereas the smooth transition from a momentary value of a parameter to a desired value corresponds to a step response of low-pass filter.

4. The method according to claim 2, whereas the smooth transition from a momentary value of a parameter to a desired value corresponds to a step response of a low-pass filter.

5. The method according to claim 1, whereas the smooth transition from a momentary value of a parameter to a desired value is generated using a ramp generator.

6. The method according to claim 2, whereas the smooth transition from a momentary value of a parameter to a desired value is generated using a ramp generator.

7. The method according to one of the claims 1 to 6, whereas one or several of the following parameters are used:

- maximum attenuation;
- width of registration;
- amplification;
- compression;
- scaling;
- operating point of a noise suppression unit;
- time constant of the compression;
- compression knee point;
- limiter;
- operating point of the suppression unit for the signal feedback;
- operating point of a recognition unit of the acoustic surrounding.

8. A hearing device operating according to claim 1, wherein at least one smooth transition filter unit having a timed response to said bi-level switching state value is provided which filter unit generates time-based transitions of parameters which are affected by hearing program switching in response to the bi-level switching state value, in that values of the parameters to be changed by a hearing program switching are passed through the filter unit in order to obtain a smooth transition from a momentary to a desired parameter value.

9. The hearing device according to claim 8, whereas the filter unit features low-pass characteristics.

10. The hearing device according to claim 8, whereas the filter unit comprises a ramp generator.

* * * * *